US006095392A

United States Patent [19]

Batts, Jr. et al.

[11] Patent Number: 6,095,392

[45] Date of Patent: Aug. 1, 2000

[54] PNEUMATIC NAILER INCLUDING SAFETY TRIGGER FOR DISABLING/ENABLING OPERATION

[75] Inventors: Namon B. Batts, Jr., Hampstead; Randy M. Brown, Wilmington, both of N.C.

[73] Assignee: Porta-Nails, Inc., Wilmington, N.C.

[21] Appl. No.: 09/245,486

[22] Filed: Feb. 5, 1999

Related U.S. Application Data

[60] Provisional application No. 60/074,625, Feb. 13, 1998.

[51] Int. Cl.[7] ..... B25C 1/04

[52] U.S. Cl. ..... 227/8; 227/130; 227/147; 227/148

[58] Field of Search ..... 227/8, 130, 136, 227/10, 147, 148

[56] References Cited

U.S. PATENT DOCUMENTS

| | | | |
|---|---|---|---|
| 3,360,176 | 12/1967 | Gehl et al. | 227/148 |
| 3,542,273 | 11/1970 | Hedrick | 227/147 |
| 4,165,676 | 8/1979 | Siegmann | 91/461 |
| 4,194,664 | 3/1980 | Siegmann | 227/8 |
| 4,346,831 | 8/1982 | Haytayan | 227/8 |
| 4,351,464 | 9/1982 | Fehrs | 227/7 |
| 4,384,668 | 5/1983 | Tutomu | 227/8 |
| 4,509,668 | 4/1985 | Klaus | 227/8 |
| 4,540,110 | 9/1985 | Bent | 227/8 |
| 4,726,504 | 2/1988 | Halbert | 227/8 |
| 4,736,879 | 4/1988 | Yamada et al. | 227/130 |
| 4,907,730 | 3/1990 | Dion | 227/8 |
| 5,014,898 | 5/1991 | Heidrich | 227/130 |
| 5,485,946 | 1/1996 | Jankel | 227/8 |
| 5,645,208 | 7/1997 | Haytayan | 227/8 |
| 5,850,961 | 12/1998 | Braun et al. | 227/8 |

*Primary Examiner*—Scott A. Smith
*Attorney, Agent, or Firm*—Dougherty & Associates

[57] ABSTRACT

A pneumatic nailer having a safety mechanism that reduces accidental discharge of nailer is provided. The nailer includes a hollow main body housing having a main pressure chamber in pneumatic communication with a main valve housing. Pressurized gas is injected into main pressure chamber, and a metering hole between the main chamber and valve assembly allows gas pressure to equalize between the main chamber and the valve housing. A safety trigger and safety valve are in pneumatic communication with the pressurized valve housing. A ram cap positioned over the top portion of the valve assembly is struck, moving the main valve assembly downward, with unseating of a cylinder firing valve only if internal pressures have been adjusted by actuation of the safety valve by an operator. When safety valve is actuated, gas pressure drops in the valve housing, reducing pressure on the main valve side of cylinder firing valve, allowing movement of main valve and cylinder firing valve, while gas pressure flows into piston cylinder, moving downward the piston and driver blade assembly, and forcing ejection of a fastener from nailer. If safety trigger is not actuated, pressure remains constant around main valve and cylinder firing valve, remaining closed, and negating upward movement of cylinder firing valve with no movement of piston and driver blade assembly, despite striking of ram cap. Thus, the possibility of accidentally driving a fastener is virtually eliminated without operator's use of the safety trigger.

18 Claims, 11 Drawing Sheets

14
10
10
20
28
72
64
10

70
28
60
36
52
26
59
38
40
50
58
55
20
54
57
32
34
45
44
48
46
22
42
62

PNEUMATIC NAILER INCLUDING SAFETY TRIGGER FOR DISABLING/ENABLING OPERATION

RELATED APPLICATIONS

This application claims the benefit of U.S. Provisional Application Ser. No. 60/074,625 filed Feb. 13, 1998.

BACKGROUND OF THE INVENTION

1. Field of the Invention

The present invention relates generally to a device for securing two or more items together. More particularly, the invention is an impact-fired pneumatic nailer having a disabling and enabling pneumatic operated safety mechanism.

2. Description of Related Art

Previously known safety systems for enabling/disabling the operation of a nailer typically comprise a feeler which is located on the underside of the body so that the nailer will operate only when the mouth of the nailer is pressed against the workpiece. This arrangement is particularly unacceptable for use in installing tongue and groove flooring because the fastener is driven through the tongue of the flooring and into the sub-floor at an angle. Accordingly, a conventional safety system will not always enable the nailer to drive a fastener. More importantly, however, the safety system may inadvertently be disengaged, thereby enabling operation of the nailer, by contacting the feeler with an object other than the workpiece, such as the user's foot or knee.

Dion, U.S. Pat. No. 4,907,730, discloses a pneumatic nailing tool operated by an impact from a hammer. The Dion nailer is provided with a needle valve that is biased outwardly from the base of the nailer. With the needle valve extended, compressed gas provided from an external source through an inlet port travels through a pair of passageways into a reservoir above closure disc until the pressure in reservoir is substantially equal to the pressure in reservoir. As a result, with the closure disc in position, the first exhaust passage is closed by a seal provided on trigger, and the second exhaust passage is open to the atmosphere, providing a safety system. The requirement that the needle valve must be retracted to operate the nailer is a safety feature to prevent inadvertent firing of the nailer. The requirement that the trigger must be impacted by hammer while the needle valve is retracted is a secondary safety feature of the Dion patent. The safety systems disclosed in the Dion patent does not prevent accidental firing of the nailer in the event of a multiple strikes.

Siegmann, U.S. Pat. No. 4,165,676, discloses a firing safety for a pneumatic nailer or stapler which cannot initiate a second cycle of the working piston even if the trigger and/or a nose piece sensor safety remain actuated. The firing safety includes a safety valve comprising an O-ring seal that seals the chamber from atmosphere when the safety valve is in the operative position. A trigger valve is movable within a valve sleeve to open and close a passageway that is in fluid communication with a pressure chamber. When the trigger valve is actuated, pin moves upwardly to seal passageway and chamber from the pressurized gas in reservoir. If safety valve is actuated, the pressurized gas in chamber and chamber exhausts to atmosphere, thereby permitting inlet valve to rise and initiate the working stroke of the cylinder. The working cylinder, however, remains in its lowermost position as long as trigger valve is actuated, therefore valve pin seals chamber from the pressurized gas in the reservoir.

Accordingly, even repeated actuation of the safety valve does not result in a subsequent working cycle until the trigger valve has been released and re-actuated.

Siegmann, U.S. Pat. No. 4,194,664, discloses a pneumatic nailer or stapler including an inlet valve for supplying compressed air to a working piston which drives a fastener. A manually operated safety valve positioned in the passageway closes an opening provided in the passageway to atmosphere when actuated. As long as the safety valve is not actuated by an operator, pressurized gas in the passageway is exhausted to atmosphere even if the trigger valve is actuated. Thus, two separate actions, namely movement of the safety cap and the trigger lever, are required to initiate a cycle of the working piston.

Fehrs, U.S. Pat. No. 4,351,464, discloses a pneumatic fastener driving tool including a manually actuated release lever which, in conjunction with a pilot release valve connected to a workpiece contact sensor, controls the supply of compressed air to the working piston. An operator actuates lever with contact sensor. Only then is the compressed air in reservoir permitted to flow into pressure chamber through bore to raise the slide rod upwards into contact with the underside of the locking pin.

Tutomu, U.S. Pat. No. 4,384,668, discloses a safety system for a pneumatic impact tool, such as a nailer, for driving a fastener that prevents accidental injury which can occur at the instant that the tool is connected to a compressed air source. The safety system is automatically engaged when the tool is disconnected from the compressed air source, and must be manually disengaged before the tool can be used to drive a fastener. The safety system includes a safety valve piston reciprocally mounted in a safety valve cylinder. The safety valve piston is automatically moved to the top dead center position when the compressed air source is activated. To disengage the safety system, the operator must manually move the safety valve piston by manipulation of the unlocking knob to the bottom dead center position. In this position, communication between the first control air passage and the second control air passage is established so that air pressure in the control chamber is available to the trigger valve to control the operation of the nailer.

Haytayan, U.S. Pat. No. 5,645,208, discloses a pneumatic fastener driving apparatus provided with a pneumatic safety mechanism to prevent accidental firing of the tool. The apparatus includes a safety interlock valve comprising a mechanical locking member that is movable pneumatically between a first trigger-locking position and a second trigger-unlocking position when a safety rod is retracted.

Klaus, U.S. Pat. No. 4,509,668, discloses a pneumatically operated fastener driving tool including a safety device to prevent operation of the tool until a safety nose that is normally extended is in engagement with the workpiece. The tool includes a first valve that controls the flow of compressed air to the driving piston and a second valve that controls the flow of air to the safety mechanism. The trigger initially opens the second valve to extend the safety nose, and subsequently effects operation of the first valve once the safety nose engages the workpiece.

Bent, U.S. Pat. No. 4,540,110, discloses a pneumatic bone stapler including means for releasably latching the driver in its load position so that a user cannot inadvertently fire a staple. The latching means automatically engages the driver with the housing on return to the load position from the eject position of the driver. A manually actuated button is provided on the housing for releasing the latching means to permit movement of the driver to the eject position.

Halbert, U.S. Pat. No. 4,726,504, discloses a pneumatically operated, portable, self-piercing riveting apparatus including a plurality of links. The links serve as a locking means to prevent operation of the apparatus when the ends of the links are aligned in a co-linear relationship. In such position, a force applied to the anvil by the apparatus driver is not transmitted to the actuator. The apparatus does not drive a self-piercing rivet unless the user positions the links out of alignment.

Existing mechanically operated safety devices for pneumatic nailers are prone to an accidental firing from a unintentional multiple or "double-strike by the operator. A "double-strike" occurs after a nail has been intentionally discharged from the pneumatic nailer. If no mechanically operated safety device is in place or is bypassed in some manner, an unintentional discharge can occur by accidentally firing the nailer's trigger which will cause the pneumatic nailer to fire another fastener. As a result, serious injury can occur to the operator of the tools or to others nearby.

A need, therefore, exists for a pneumatic nailer that has a safety mechanism for preventing an accidental firing of the nailer in the event of multiple, unintended striking of the nailer by the operator.

SUMMARY OF THE INVENTION

The present invention is a impact-fired pneumatic nailer having a pneumatic safety apparatus and method of operation that virtually eliminates the possibility that the pneumatic nailer will accidentally discharge a fastener. The invented pneumatic nailer is intended for use in fastening tongue and groove building materials, and includes a pneumatic safety mechanism having a hollow main housing body enclosing a main body pressure chamber that is in pneumatic communication by a metering hole with an adjacent main valve assembly having a ram cap above a main valve assembly, main valve seals, a cylinder firing valve separating the main valve from a piston chamber, a driver blade assembly within a piston cylinder, and a cylinder exhaust valve. An inlet port positioned on the main body permits gas from a remote pressurized gas source to pressurize the main body pressure chamber.

The main valve assembly is positioned forward of the handle and adjacent the main body with a metering hole opening providing pneumatic communication between the main body pressure chamber and the main valve assembly. The main valve assembly includes a hollow main valve housing forming a valve pressure chamber having a main valve seal between the valve chamber and the piston chamber. A ram cap positioned over the top portion of the main valve provides a surface which can withstand repeated strikes with a tool. Striking the ram cap actuates the main valve, dislodging the main valve seal and cylinder firing valve, if the safety trigger has been actuated to unbalance the pressure on the main valve side of the cylinder firing valve. When the cylinder firing valve moves upward, air pressure moves into the piston cylinder, which drives the piston and driver blade assembly downward, forcing pneumatic discharge of a fastener from a nail stack positioned on a lower section of the main body, opposite the handle.

The pneumatic nailer has a hollow handle bolted onto, and positioned above the main body pressure chamber adjacent the main valve assembly. The hollow handle has a safety trigger in pneumatic communication with a handle passageway that is in communication with the main valve pressure chamber.

A metering hole opening formed in the forward area of the main body pressure chamber provides a passageway for pressurized gas to travel from the main body pressure chamber to the main valve pressure chamber. The metering hole operates to equilibrate the pressures between the main body pressure chamber and the main valve pressure chamber. When the safety trigger is actuated at least once, air pressure drops on the main valve side of cylinder firing valve as gas is allowed to pass out of handle passageway via safety trigger valve. The reduced air pressure around the main valve side of cylinder firing valve allows movement of the cylinder firing valve, allowing air pressure to move into the piston cylinder, driving the piston and driver blade assembly downward, forcing ejection of a fastener from a lower discharge opening of the piston chamber.

If safety trigger is not actuated, gas does not exit through the handle passageway, and pressure remains constant in, and around the main valve and cylinder firing valve as provided by air pressure through the metering hole, and no movement of the cylinder discharge valve occurs despite repetitive hammer blow strikes on the ram cap. Therefore any movement downward of the piston, and driver blade assembly, must be proceeded by at least one actuation of the safety trigger by an operator. If the safety trigger is held closed, with resulting holding of the safety valve in an open position, then lesser air pressure is maintained on the main valve side of the cylinder firing valve, and repetitive hammering of the ram cap will provide for repetitive discharge of fasteners.

The invented pneumatic nailer includes a reset chamber formed in the hollow main housing body of the pneumatic nailer. The piston chamber cylinder is positioned ahead of and between the main body pressure chamber and the reset chamber. The piston chamber cylinder defines a central axis which is coaxial with the main valve positioned above the cylinder. A piston/driver blade assembly is reciprocally mounted within the cylinder. A driver blade extends downward from the piston/driver blade assembly along the central axis of the cylinder. The driver blade, when activated, will drive a fastener out of the nail stack to secure two or more items together.

The reset chamber is not in direct pneumatic communication with the main valve body pressure chamber. The cylinder firing valve, cylinder exhaust valve, and associated "O-ring" seals between the piston chamber cylinder and the main valve body pressure chamber prevents gas from flowing from the reset chamber and piston chamber cylinder to the main valve pressure chamber. The pressure of the gas in the reset chamber causes the piston/driver blade assembly to return upward to its initial position. When the piston/driver blade assembly returns to the initial position, the gas located above the piston will be discharged out through the cylinder firing valve.

Accordingly, one of the objects of the present invention is to provide a pneumatic nailer that has a means for avoiding injury from the accidental firing of a fastener.

A further object of the invention is to provide a pneumatic nailer that only fires a fastener if an operator triggers the nailer intentionally.

An additional object of the invention is to provide a pneumatic nailer having a pneumatic safety mechanism that is self-sealing to prevent unintentional firing of fasteners.

BRIEF DESCRIPTION OF THE DRAWINGS

In view of these and other objects which will more readily appear as the nature of the invention is better understood, the invention consists in the novel combination and arrangement of parts hereinafter more fully described, illustrated and claimed with reference being made to the attached drawings in which:

DESCRIPTION OF THE PREFERRED EMBODIMENTS

Figure 1:
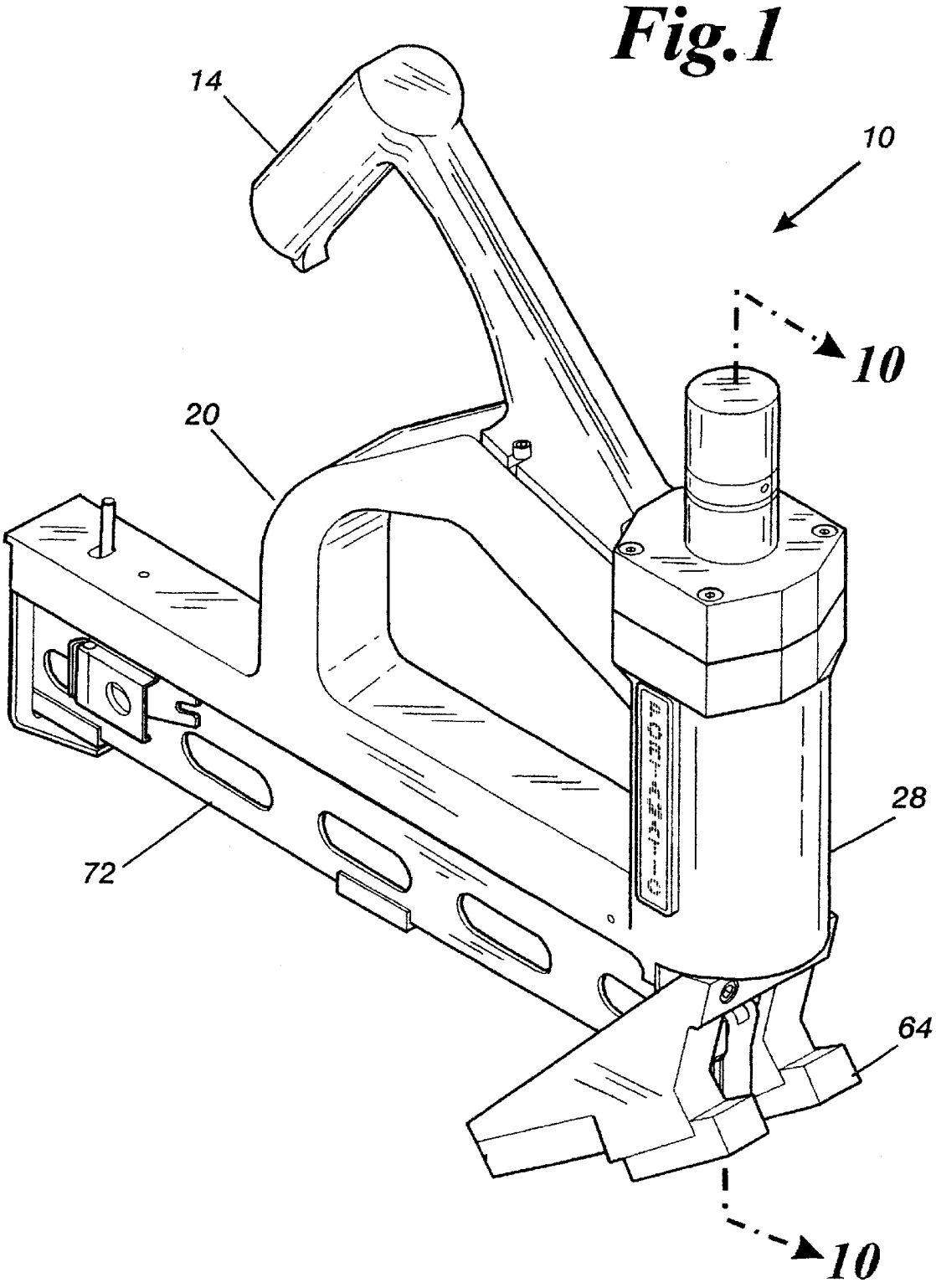
FIG. 1 is a perspective view of the invented pneumatic nailer having a safety mechanism for preventing unintentional ejection of fasteners from the nailer.

The invented device is a pneumatic tool, such as a nailer, that includes a pneumatic safety mechanism for preventing unintentional ejection of a fastener. In a preferred embodiment, the invented device is a pneumatic nailer 10, for securing two or more items together with a fastener such as a nail. The pneumatic nailer 10 is particularly suited for installing tongue and groove type flooring, and any relatively flat cover onto a relatively flat surface.

As illustrated in the FIGS. 1–9, the nailer 10 includes three main body assemblies, the first assembly including a hollow handle 14 having a handle passageway 18 therethrough, with the handle 14 positioned on the top outside surface of a main housing body 12. The handle has a safety trigger 68 on the exterior, and a safety valve 69 inside, within the handle passageway 18, which serves as an outlet for gas from the second assembly described below.

The second assembly includes a pressurized hollow main housing body 12, located below and fastened to the hollow handle 14. An air fitting 16 is positioned on the main body 12 and acts as an inlet port for connecting the pneumatic nailer 10 to a pressurized gas source (not shown), that provides a supply of pressurized gas, such as compressed gas or air, to the main pressure chamber 20. The nailer may have a reset button 66, which if utilized is positioned on the main body 12 and acts to assist in resetting the piston to a top position within the piston chamber 29. The main body pressure chamber 20 is in pneumatic communication by a metering hole 50 with main valve housing 28 located forward of the main housing body 12.

Figure 10:
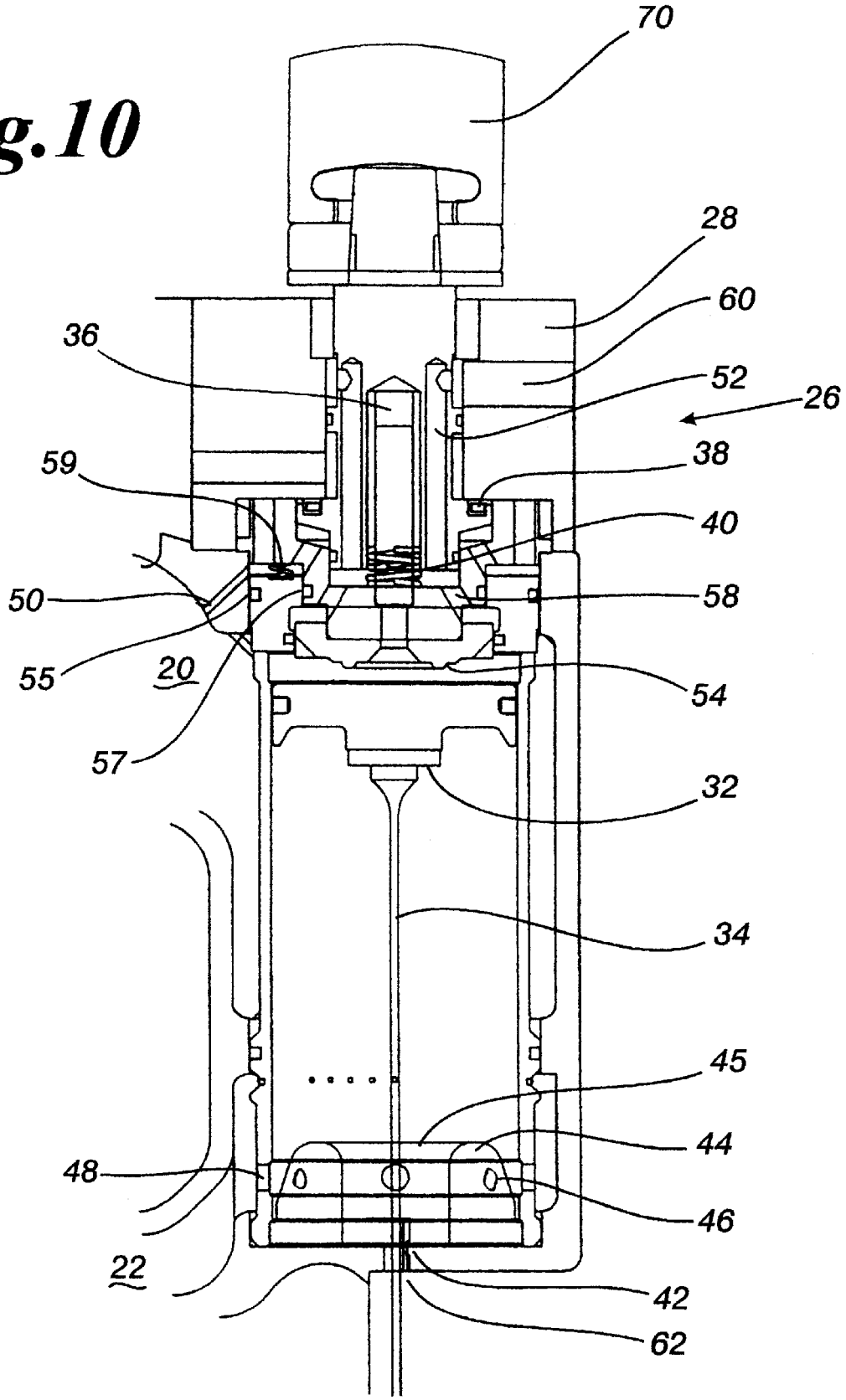
FIG. 10 is a cross-sectional view of the valve body and main valve housing elements of the invented nailer.
Figure 11:
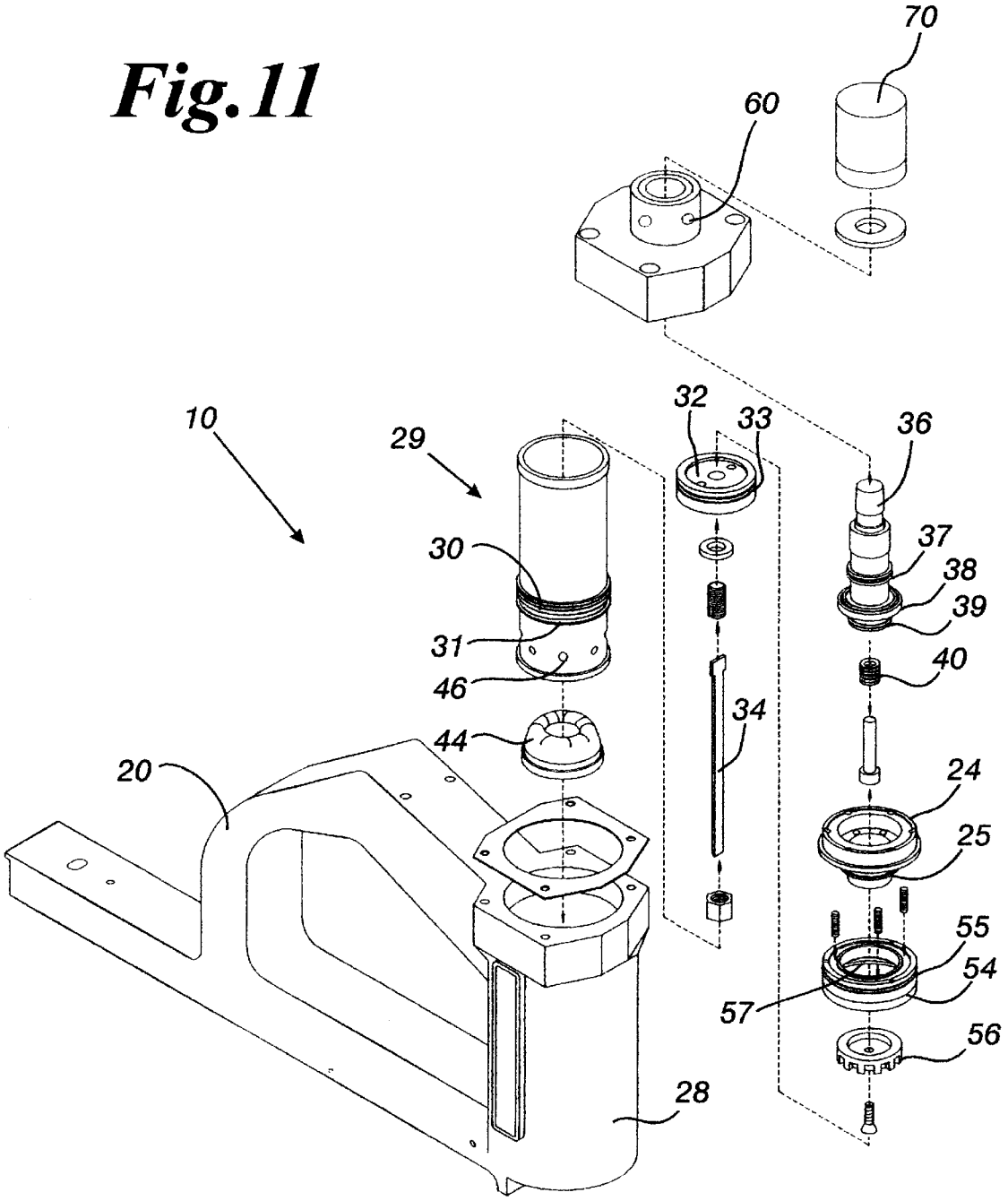
FIG. 11 is a exploded view of the invented nailer showing the details of elements within the valve body, main valve housing, and piston cylinder of the invented nailer.

As shown in FIGS. 10 and 11, the third assembly includes the main valve body 24 inside the main valve assembly 26 positioned adjacent and in front of the handle 14, and in front of the main pressure chamber 20. The main valve assembly 26 includes the cylindrical valve body 24 within the main valve housing 28, with the valve body 24 fitting around the lower end of a cylindrical main valve 36. The main valve housing 28 walls are capable of containing pressurized gases from the main body pressure chamber 20. Normal gas pressure within the main pressure chamber 20 is approximately 75 to approximately 90 lbs./in$^2$, with normal operating gas pressure preferably not exceeding approximately 110 lbs./in$^2$.

The main valve seal 38, an "O-ring" or Tetraseal, is on the exterior of the lower middle diameter of the main valve 36, is in contact with the interior of the main valve housing 28. The valve body 24 partially encloses a lower section of main valve 36. The lower portion of valve body 24 is in contact with the cylinder firing valve 54, which has a perimeter firing valve seal 55 that is in contact with the interior cylindrical walls of the main valve housing 28. The main valve 36 also has an upper main valve seal 37 that is in contact with the interior cylinder walls of the main valve housing 28. The lower interior portion of a ram cap 70 is in contact with the upper end of the main valve 36. The main valve 36 has a lower end having a lower main valve seal 39. The lower main valve seal 39 is in contact with the interior diameter of the cylindrical valve body 24, which forms a pneumatic seal with the valve body 24. The ram cap 70 is positioned over an upper portion of the main valve 36, and is made of a durable material so that an operator can strike the ram cap 70 repeatedly to initiate the internal pneumatic mechanisms to force firing of the nailer 10 if a safety lever 68 and safety valve 69 has been actuated by the operator.

Below the lower main valve seal 39 on the main valve 36, is a valve body 24 and a cylinder firing valve 54, that are in air-tight communication with the lower portion of the main valve 36. The cylinder firing valve 54 is the main element separating the pressures maintained in the valve housing 28, and the separate pressures in the piston cylinder 29. The cylinder firing valve 54 has an "O-ring" or cylindrical firing valve seal 55 around the outer diameter of the cylinder firing valve 54, with the exterior firing valve seal 55 in communication with the walls of the main pressure chamber 20 below the metering hole 50. The cylindrical interior of cylinder firing valve 54 has an interior firing valve seal 57 that seals the firing valve 54 with a cylinder exhaust valve 56 that inserts from below into the interior opening of the firing valve 54, and is fastened to the lower portion of the valve body 24 which has a valve body lower seal 25 that seals with the exhaust valve 56.

The exhaust valve 56 has a plurality of holes or vent openings therethrough that allow exhaust, or return/upstroke, gases from the piston chamber cylinder 29 located below the cylinder firing valve 56, to vent to main valve body exhaust holes 58 and exhaust channels 52. Exhaust or up-stroke gases are directed from exhaust channels 52 to a plurality of exhaust ports 60 located on the upper portion of the main valve assembly 26 below the ram cap 70.

The exhaust or up-stroke gases are purged from the piston chamber cylinder 29 as the piston 32 returns to its initial upper position within the piston chamber cylinder 29 after the pneumatic nailer 10 has fired. The piston 32 has an exterior piston "O-ring" 33 that contacts the interior walls of the cylindrical piston chamber cylinder 29. The piston chamber cylinder 29 is set into the lower portion of the main valve housing 28. The piston cylinder 29 has an upper protruding "O-ring" seal 30 around the exterior of the cylinder 29, which seals the gases in main pressure chamber 20 from the reset chamber 22. A lower recessed "O-ring" seal 31 is located around the exterior of the piston cylinder 29, with seal 31 limiting the passage of pressurized gasses from the lower portion of the cylinder 29 past the piston 32 and piston "O-ring" 33, assisting the pneumatic transfer of gas pressures upward through the cylinder 29 for forceful return stroke of the piston after the ejection of a fastener from the lower center opening 42 of the piston cylinder 29.

A driver blade assembly 34 is reciprocally mounted within the piston chamber cylinder 29, below the piston 32, below the cylinder firing valve 54 and the cylinder firing valve 56. The driver blade 34 transmits the downward vertical movement of the piston 32 within the piston chamber cylinder 29, for forceful ejection of a fastener from the center opening 42 of the piston cylinder 29.

A ring shaped piston cushion 44 is positioned at the bottom of, and within the chamber cylinder 29, below the piston assembly 32. The driver blade 34 extends downward from the piston assembly 32 through the center opening 45 of the piston cushion 44.

The piston chamber cylinder 29 defines a central axis and the main valve 36 is coaxial with the central axis of the chamber cylinder 29. The main valve return spring 40 is positioned between a lower portion of the main valve 36 and the valve body 24. The cylinder firing valve 54 is mounted above the piston assembly 32. The main valve return spring 40 biases the main valve 36 toward a position at the upper portion of the main valve housing 26 to maintain closure of the cylinder firing valve 54. Once the main valve 36 and cylinder firing valve 54 are seated, the gas pressure is equalized between the interior of the main valve housing 28 and the piston cylinder 29 by passage of pressurized gas through the metering hole 50 into the main valve housing 28. Cylinder firing valve springs 59, located between the firing valve 54 and the valve body 24, also move the firing valve 54 to seal against the top of piston cylinder 29. Pressures on either side of the firing valve 54 will remain equivalent until re-actuation of the safety trigger 68 and safety valve 69, which allows release of pressure within the main valve housing 28.

Operation of Pneumatic Nailer:

When a hammer blow strikes the ram cap 70, force from the blow may move downward the main valve 36, attached to lower end of ram cap 70, forcing upward the cylinder firing valve 54, if the pressures within the main valve housing 28 have been lessened by prior actuation of the safety trigger 68 and safety valve 69. If the safety valve 69 has not been held open, therefore not allowing release of air pressure from the main valve housing 28, then hammering on the ram cap 70 will only move the main valve 36 a minimal distance, and will not unseat the cylinder firing valve 54.

If safety trigger 68 and safety valve 69 is actuated before the ram cap 70 is hammered, gas exits from the main valve housing 28 via the handle passageway 18 to the atmosphere, allowing for a lowered pressure on the main valve 36 side of the cylinder firing valve 54, as compared to the pressures in the piston cylinder 29 below the cylinder firing valve 54. The lowered pressure in the valve body 24 overcomes the force of the cylinder firing valve spring 59. Consequently, the cylinder firing valve 54 is moved away from the top of the cylinder 30 and gas from the main pressure chamber 20 can enter the piston chamber cylinder 29. The lowered gas pressure on the main valve 36 side allows the pressured gas on the piston cylinder 29 side to lift the cylinder firing valve 54, allowing pressurized gas to enter piston cylinder 29, for movement of piston 32 and driver blade assembly 34 downward when a hammer strikes the ram cap 70, causing the pneumatic nailer 10 to eject a fastener.

Figure 7:
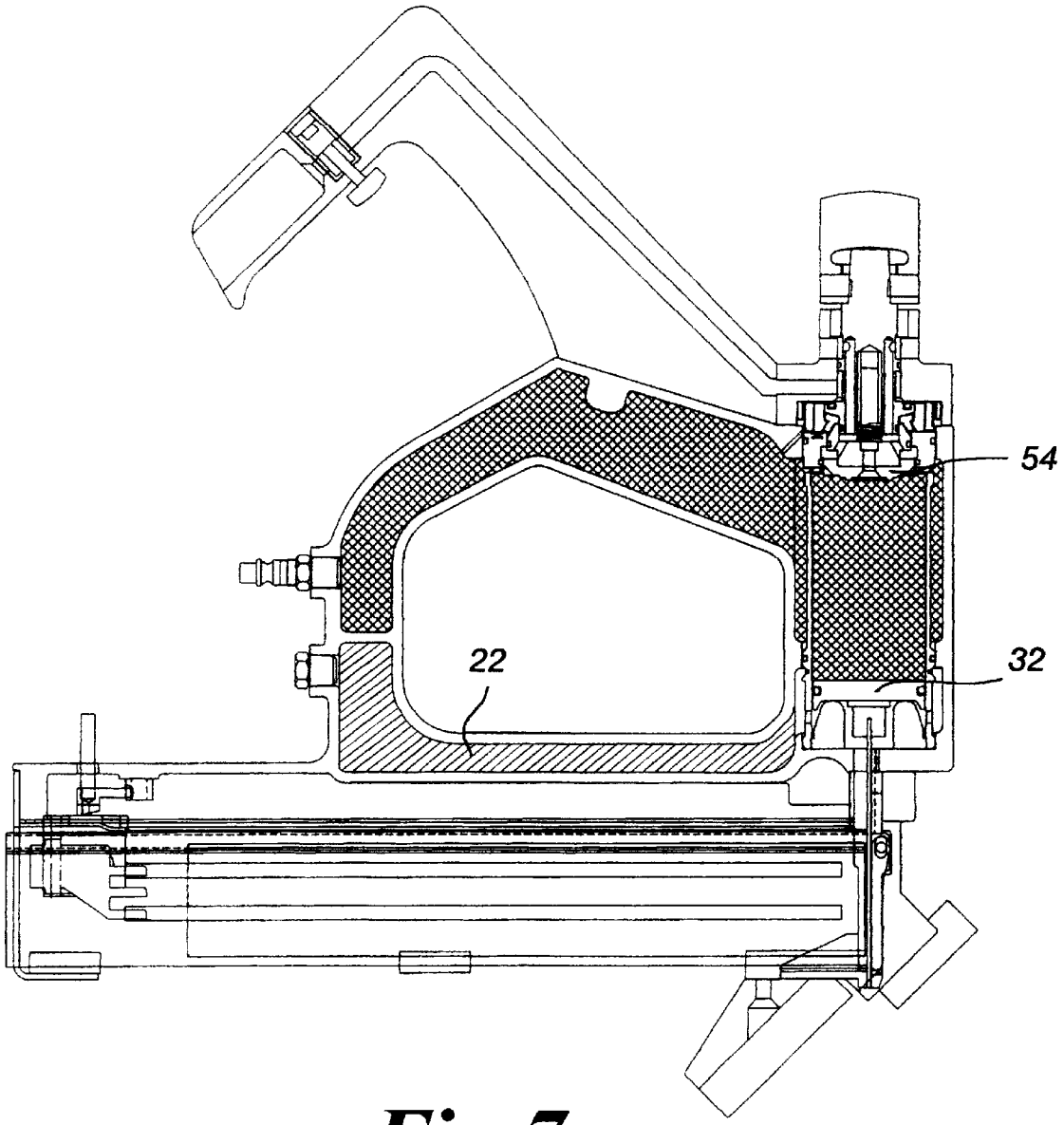
FIG. 7 is a cross-sectional side view of the invented nailer showing the safety valve in the closed position, and the piston assembly and driver blade assembly in a full downward position within the piston cylinder of the nailer.

After movement of main valve 36 and cylinder firing valve 54, the valve elements are replaced to a neutral position by the main valve return spring 40 and the cylinder firing valve springs 59 (see FIG. 7). When the cylinder firing valve 54 is closed, the gas pressure is equalized between the interior of the main valve housing 28 and the piston cylinder 29 by passage of pressurized gas through the metering hole 50 into the main valve housing 28.

The air pressures transmitted through the metering hole 50 operate in concert with the safety trigger 68 and safety valve 69, to limit the ability of the cylinder firing valve 54 to move despite hammer blows on the ram cap 70, limiting firing of the nailer until the safety trigger 68 and safety valve 69 are actuated. The operator may maintain the trigger 68 and valve 69 in an actuated position, allowing for multiple, successive firings of fasteners if multiple hammer blows are applied to the ram cap 70.

The force of the gas entering the piston cylinder 29 causes the piston 32 and driver blade assembly 34 to move downward in the piston chamber cylinder 29, thereby causing the driver blade 34 to fire a fastener from a nail stack 72 into the object to be fastened. The nail stack 72 is positioned on the bottom outside surface of the main body 12, with repetitive feeding of fasteners into the lower area of the piston cylinder 29 and to a discharge area 62 of the nail stack for discharge each time the driver blade 34 moves down the piston cylinder 29. Approximately two clips of fasteners, such as nails or staples, are positionable in the nail stack 72. A guide 64 extends from the bottom outside surface of the discharge area 62 of the nail stack 72. The guide 64 is in contact with a guide shoe (not shown) that contacts the tongue and groove pieces to be nailed in place by a fastener discharged from the pneumatic nailer 10.

Figure 2:
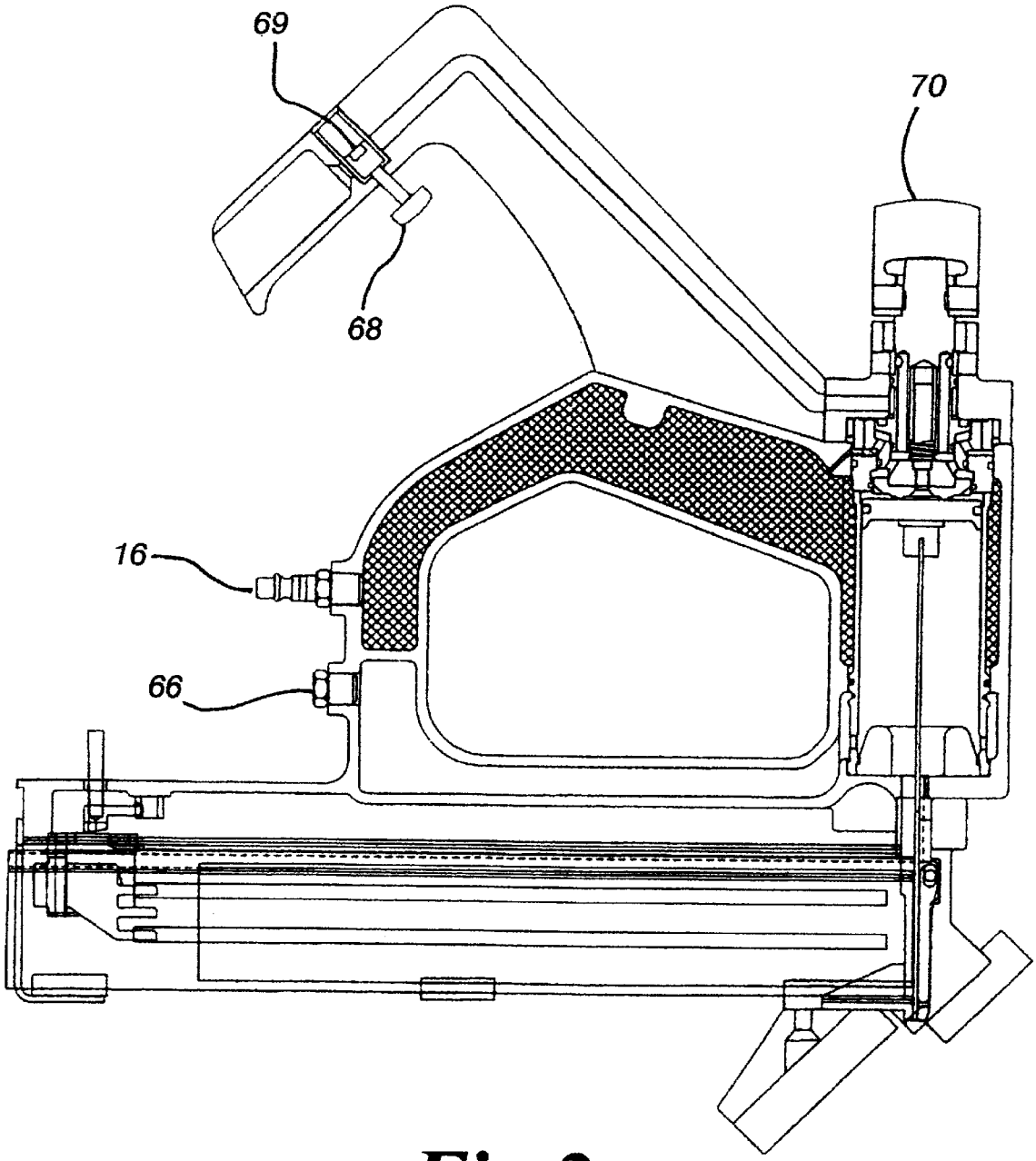
FIG. 2 is a cross-sectional side view of the invented nailer taken along line A—A of FIG. 1, with pressurized gases in the pressure chamber of the nailer.
Figure 3:
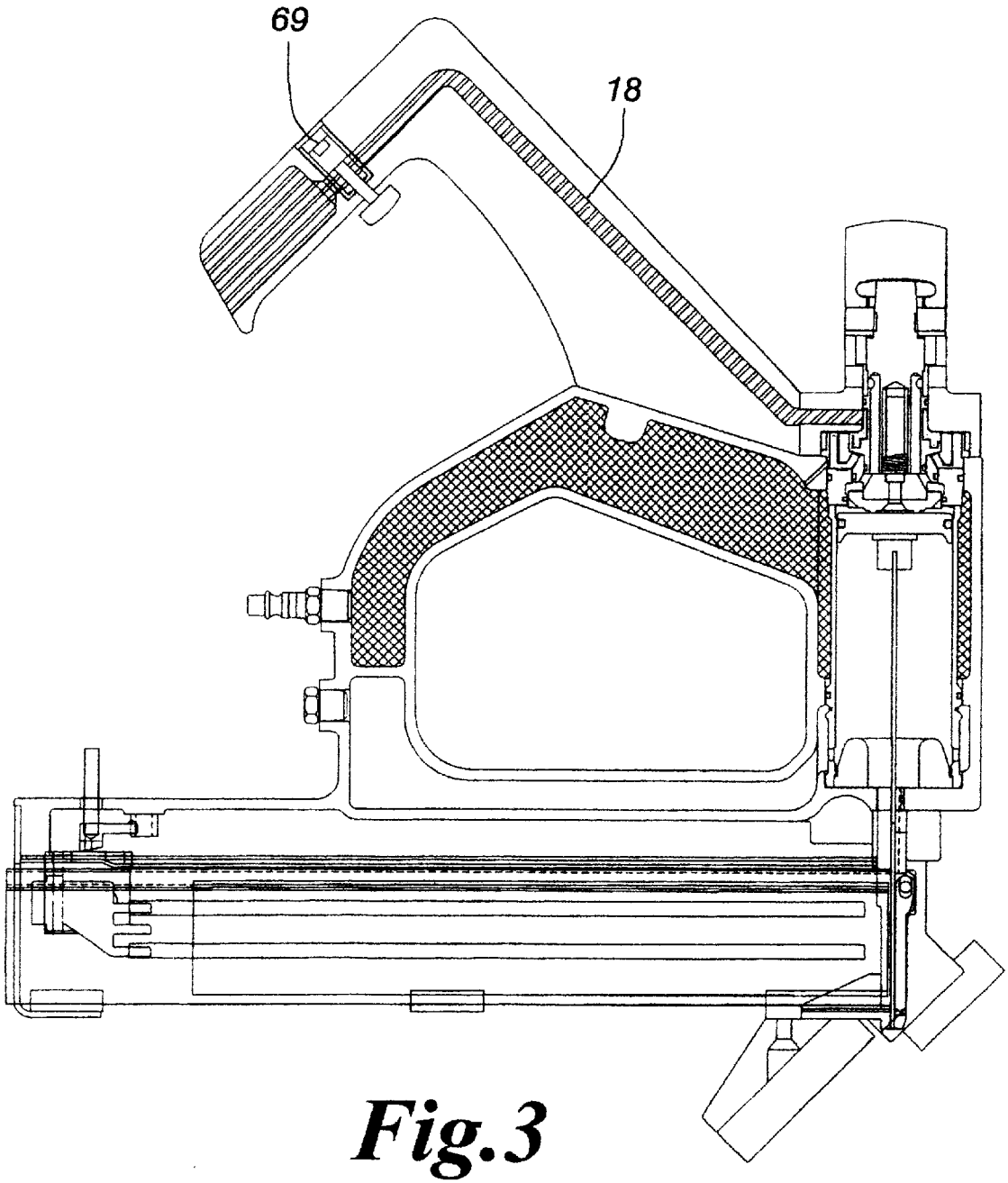
FIG. 3 is a cross-sectional side view of the invented nailer, after the safety valve has been actuated to allow the release of gases through the handle passageway of the nailer.

FIGS. 2–9 show the progression of the gas through the invented pneumatic nailer 10 during operation. As shown in FIG. 2, the pneumatic nailer 10 is in a ready position where the main valve 36 is in an initial position. Thus configured, striking the ram cap 70 with first depressing the safety trigger 68 (FIG. 3) will cause a sequence of events to allow the pneumatic nailer 10 to fire a nail. This inherent fail-safe pneumatic safety feature, requiring actuation of the safety trigger 68 at least once before striking the ram cap 70, provides for safe operation of a nailer unlike prior mechanically actuated devices having mechanical "fail-safe" mechanisms such as spring activated "safety lock" buttons.

Figure 4:
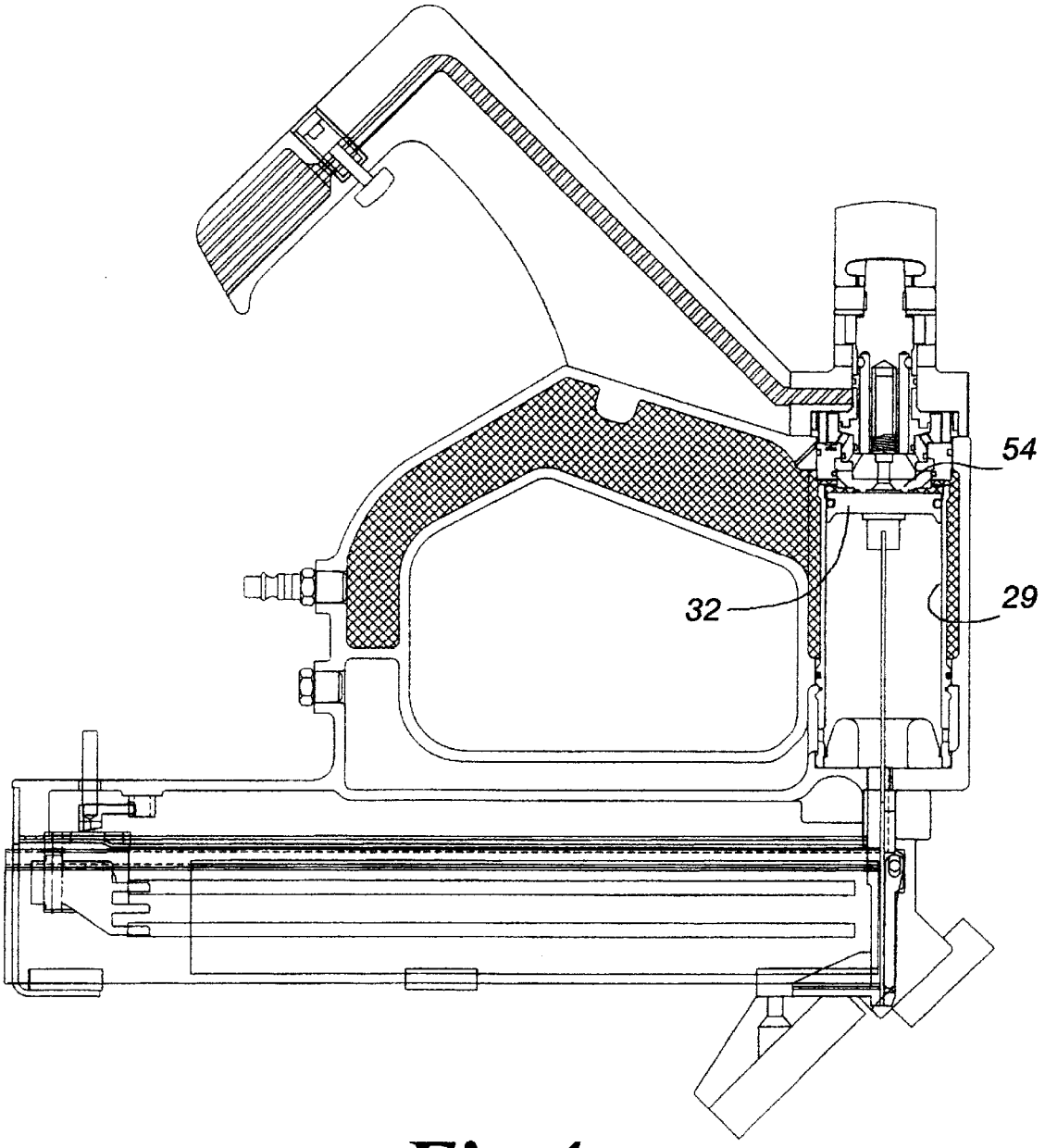
FIG. 4 is a cross-sectional side view of the invented nailer after the ram cap has been struck and after the seal has been broken between the cylinder firing valve and the top of the cylinder of the nailer.

As shown in FIG. 4, actuating the safety trigger causes the pressurized gas to evacuate from the handle passageway thereby creating a pressure differential across the main valve seal 38 and valve body 24. The resulting pressure differential within the main valve housing 28 and the main valve side of the cylinder firing valve 54 forces the cylinder firing valve 54 upwards. Pressurized gas in the main pressure chamber is now free to flow past the cylinder firing valve 54, into the piston cylinder 29, thereby applying pressure on the piston assembly 32.

Figure 5:
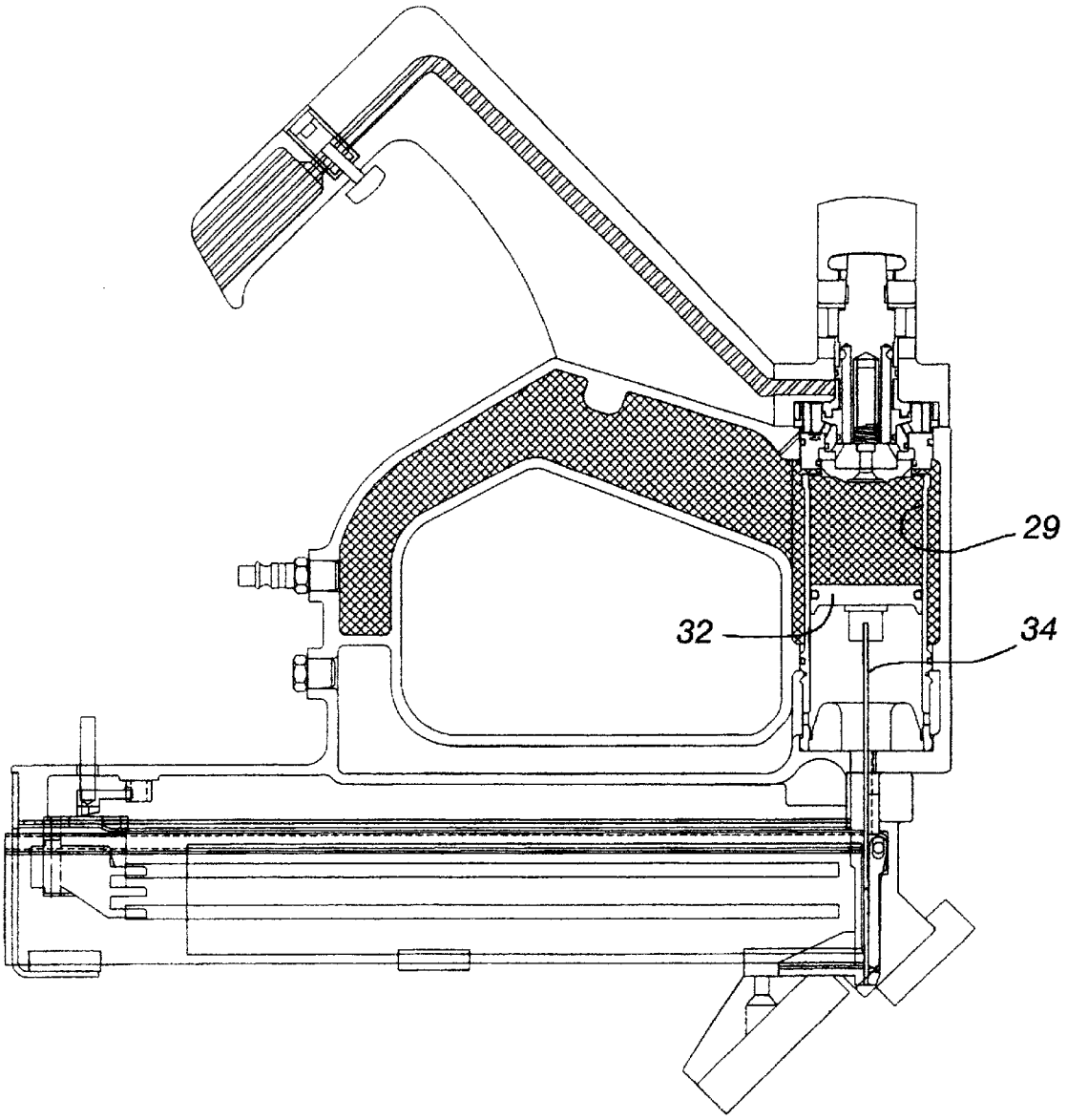
FIG. 5 is a cross-sectional side view of the invented nailer showing the piston assembly and driver blade assembly in an intermediate position as it travels down the piston cylinder of the nailer.
Figure 6:
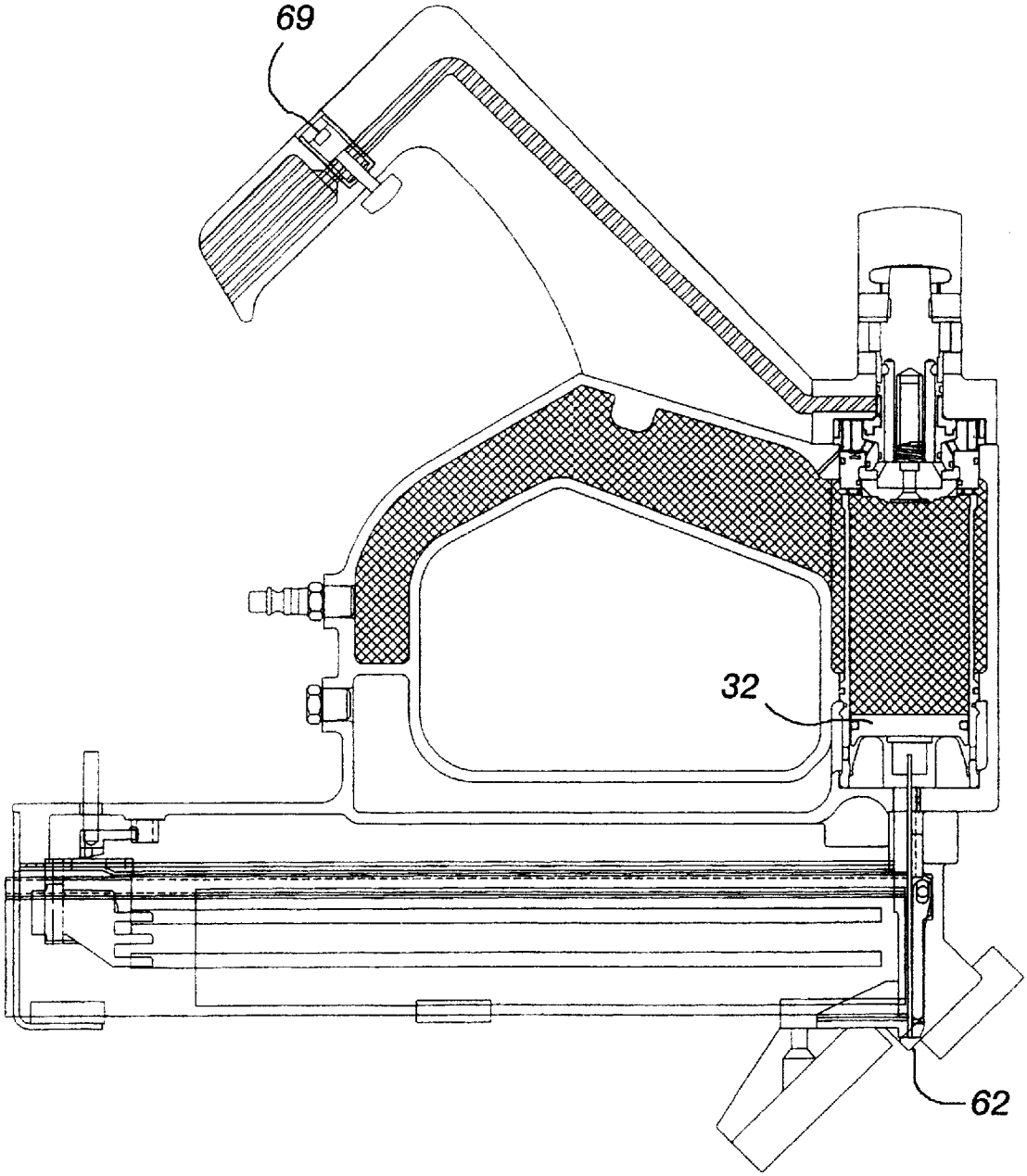
FIG. 6 is a cross-sectional side view of the invented nailer showing the piston assembly and driver blade assembly in a full downward position as the blade discharges a fastener from the nailer.

FIG. 5 shows the piston/driver blade assembly 32 and the driver blade 34 in an intermediate position in the piston chamber cylinder 29. The inflow of pressurized gas into the interior of the piston chamber cylinder 29 drives the piston/driver assembly and the driver blade 34 rapidly downward. As the driver blade assembly 34 approaches the piston cushion 44 (FIGS. 5–7), gas in the interior of the piston chamber cylinder 29 below the driver assembly is evacuated into the reset chamber 22 through the holes 46 formed in the piston chamber cylinder 29 around the ring shaped piston cushion 44, and through the channel 48 to the reset chamber 22.

Figure 8:
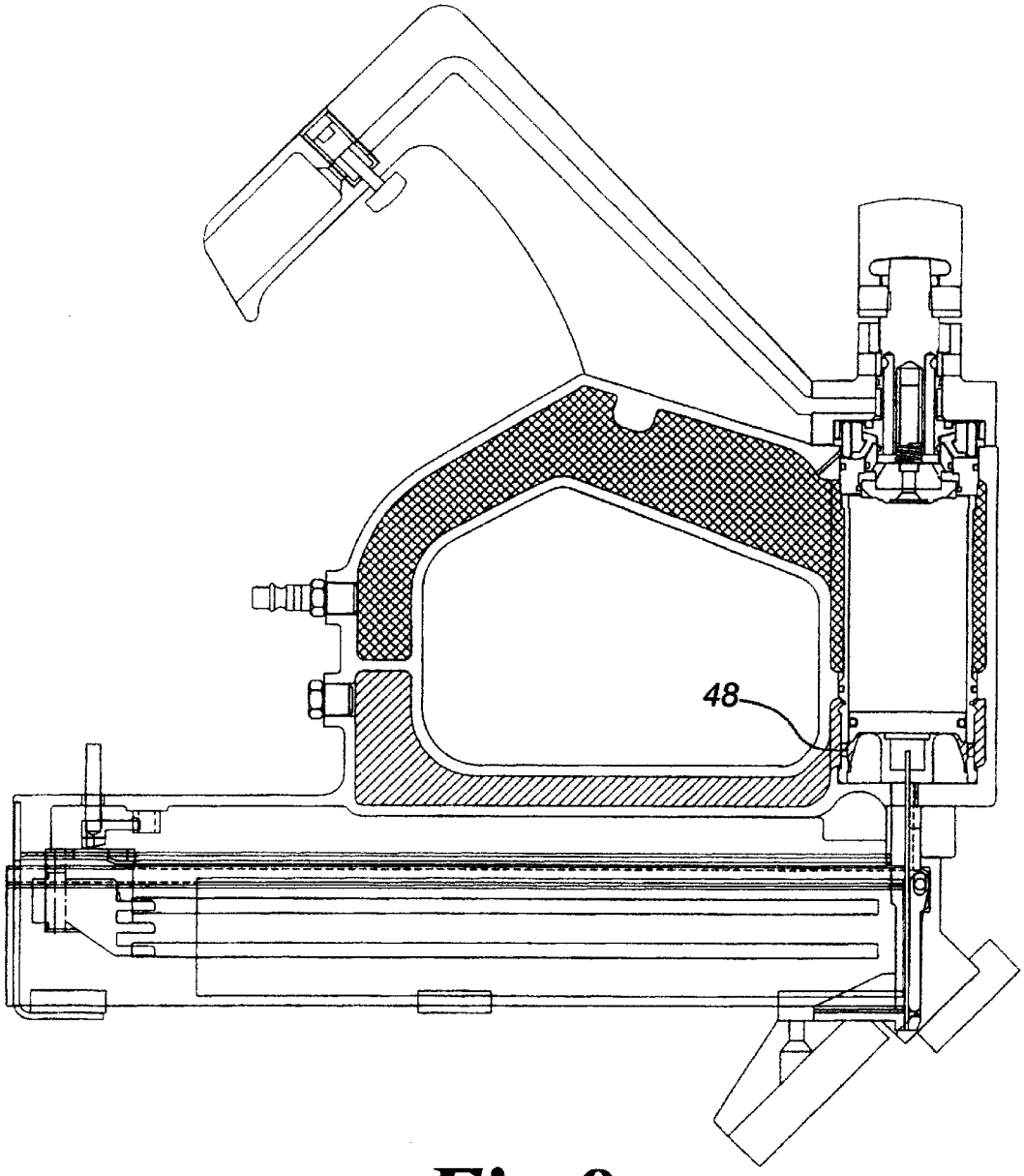
FIG. 8 is a cross-sectional side view of the invented nailer showing the gases within the reset chamber as the gases begin to move into the lower portion of the piston cylinder of the nailer.
Figure 9:
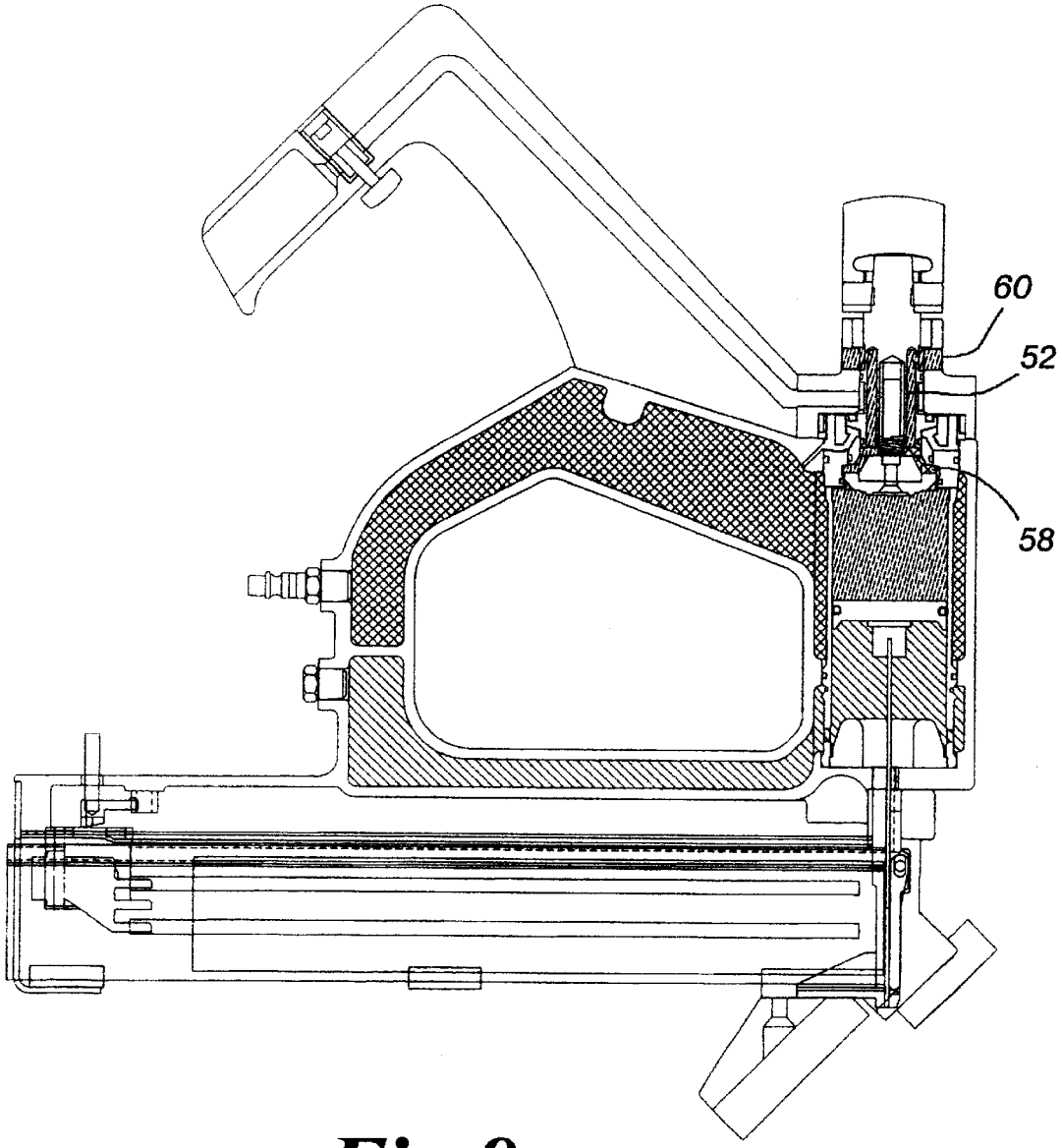
FIG. 9 is a cross-sectional side view of the invented nailer showing the gases within the reset chamber moving the piston assembly and driver blade assembly upwards within the piston cylinder of the nailer, while exhaust gases escape from main valve housing.

As shown in FIGS. 7 and 8, once the piston/driver assembly and the driver blade reach the piston cushion 44, nearly all of the gas in the cylinder below the piston/driver assembly 32 has been forced into the reset chamber 22. When the driver blade 34 is fully extended downward in the piston cylinder 29, a fastener is fired into the material to be joined. The main valve return spring 40 and cylinder firing valve springs 59 will force the main valve 36, and cylinder exhaust valve 56 back to initial positions, thereby allowing pressures to equalize between the main valve housing 28, as fed by pressurized air from the metering hole 50, and the main pressure chamber 20. Stored pressurized air in the reset chamber 22, will move back into piston chamber 29 for driving the piston 32 and drive blade 34 back up to the upper end of piston chamber 29, underneath the sealed cylinder exhaust valve 56 and cylinder firing valve 54 (see FIGS. 8 and 9). The exhaust valve 56 and valve body exhaust channels 52 allow gases to escape from the main valve housing 28 through the exhaust ports 60.

As explained above, a method of operation is also disclosed in that the nailer 10 operates by the following steps. The initial pressures within the main pressure chamber 20 are approximately 75 lbs./in$^2$, to approximately 90 lbs./in$^2$, with associated pressurization of the main valve housing 28 by means of the metering hole 50. While maintaining the pressures of about 75 to about 90 lbs./in$^2$, on the main valve side of main valve 36 and cylinder firing valve 54, any hammer blow and other strikes to the ram cap 70 will not provide an adequate pressure differential for cylinder firing valve 54 to open and allow gas pressure to enter the piston cylinder 29, thereby negating accidental release of fasteners. Re-activating the safety lever 68 and safety valve 69 by the operator will allow firing of a fastener.

SUMMARY OF THE ACHIEVEMENT OF THE OBJECTS OF THE INVENTION

From the foregoing, it is readily apparent that I have invented a pneumatic nailer that has a pneumatic safety system for preventing the accidental firing of the nailer in the event of repetitive striking of a ram cap of the nailer. The preferred sequence of events, as described above, must proceed before a fastener is fired from the pneumatic nailer.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A safety apparatus incorporated with a pneumatically operated tool for fastening articles with fasteners, said safety apparatus and tool comprising:

a main body, said main body having a pneumatic main chamber formed therein, said pneumatic main chamber having a gas fitting for entry of compressed gas into said main chamber;

a main valve housing positioned adjacent to said main chamber, said valve housing including a valve chamber and a means for transfer of compressed gas from a lower end of said valve housing;

a metering channel between said main chamber and said valve chamber of said main valve housing, said channel provides pneumatic communication between said main chamber and said valve chamber;

a cylinder positioned below said valve housing, said cylinder in pneumatic communication with said valve chamber at an upper first end of said cylinder, said cylinder axially aligned with said main valve housing, said cylinder having a discharge opening in a second lower end of said cylinder;

a main valve within said valve housing and oriented above said upper first end of said cylinder;

a piston within said cylinder, said piston reciprocatable in an up and down motion within said cylinder;

a driver blade assembly positioned below said piston, said driver blade assembly extends down said cylinder when said piston moves down said cylinder;

a fastener discharged from said second lower end of said cylinder when said driver blade assembly drives said fastener from said discharge opening in said cylinder;

a handle above said main body, said handle having a pneumatic handle passageway formed therein, said passageway in pneumatic communication with said valve housing; and a safety valve in said handle, said safety valve connected to a safety trigger on said handle, said safety valve in pneumatic communication with said passageway, said safety trigger releases gas from said passageway when said safety trigger is actuated;

whereby said metering hole maintains said valve housing in constant pneumatic communication with said main chamber; and whereby said safety trigger is manipulated, and said safety valve is actuated at least once before discharge of said fastener for initiation of a sequential discharge of said fastener from said pneumatic tool.

2. The safety apparatus and pneumatic tool of claim 1, wherein said transfer means further comprises:

a ram cap forming an upper end of said valve housing, said ram cap is strikable by a hammer;

said main valve within said main valve housing is located below said ram cap;

said main valve within said valve housing moves downward when said ram cap is struck;

a cylinder firing valve located below said main valve;

a lower opening in said lower end of said valve housing;

said cylinder firing valve positioned within said lower opening; and a main valve return spring below said main valve;

whereby said ram cap displaces said main valve, said cylinder firing valve is displaced in conjunction with said main valve, with transfer of pressurized gas into said cylinder positioned below said valve housing, with resulting displacement downward of said piston.

3. The safety apparatus and pneumatic tool of claim 1, wherein said hollow handle is attachable behind said valve housing, said handle passageway remains blocked by safety valve until an operator actuates said safety lever.

4. The safety apparatus and pneumatic tool of claim 1, wherein said hollow main body further comprises a reset chamber which is not in fluid communication with said main chamber formed within said main body, said reset chamber is in pneumatic communication with said cylinder.

5. The safety apparatus and pneumatic tool of claim 1, wherein said safety valve within said passageway is in pneumatic communication with said valve housing, said valve is opened when said safety trigger is actuated, and said valve is closed when said safety trigger is released.

6. The safety apparatus and pneumatic tool of claim 1, wherein said cylinder defines a central axis and wherein said main valve is coaxial with said central axis of said cylinder and is positioned above said cylinder.

7. The safety apparatus and pneumatic tool of claim 1, wherein said pneumatic main chamber further comprising an inlet port in a wall of said main chamber, said inlet port permits compressed gas to feed into said pneumatic main chamber.

8. The safety apparatus and pneumatic tool of claim 7, wherein said inlet port is attachable to a pressurized gas source for supplying a pressurized gas to said pneumatic main chamber through said inlet port.

9. The safety apparatus and pneumatic tool of claim 1, wherein said fastener comprises a nail stack positioned on said main body opposite said handle, said nail stack further comprising a plurality of fasteners positioned in said nail stack, said plurality of fasteners are fed to said discharge opening by said nail stack.

10. The safety apparatus and pneumatic tool of claim 9 further comprising a driver blade assembly reciprocally mounted within said cylinder along said axial alignment with said cylinder, said driver blade assembly drives one of said plurality of fasteners from said nail stack and out of said discharge opening for securing two or more items together.

11. A pneumatic nailer having a safety mechanism for preventing unintentional operation of the nailer comprising:

a main body forming a main pressure chamber therein;

a reset chamber below said main pressure chamber, said reset chamber is not in direct pneumatic communication with said main pressure chamber;

a main valve assembly positioned forward of said main body, said main valve assembly including:

a cylindrical main valve housing having a main valve positioned in said main valve housing, said main valve having a lower end extending downward into said main valve housing;

interior walls of said main valve housing, said walls form a main valve housing;

a plurality of main valve seals on the exterior of said main valve, said main valve seals are in contact with said internal walls of said main valve housing;

a valve body located around said lower end of said main valve; and wherein said main valve housing is in constant pneumatic communication with said main pressure chamber through said metering hole when said main valve is in a neutral position;

a metering hole formed in said main pressure chamber, said metering hole communicating between said main pressure chamber and said main valve housing;

a hollow handle positioned on said main body, said hollow handle forming a handle passageway that is in pneumatic communication with said main valve housing;

a safety valve in said handle, said safety valve actuated by a safety trigger, said safety valve is in pneumatic communication with said passageway, said safety valve releases gas from said passageway and from said main valve housing when said safety trigger is actuated to an open position;

a hollow piston cylinder positioned underneath said main valve housing, said piston cylinder receives pressurized gas from said main valve housing after said safety valve is actuated to said open position;

wherein said piston cylinder defines a central axis and wherein said main valve is coaxial with said central axis of said piston cylinder and is positioned above said piston cylinder.

12. The pneumatic nailer of claim 11, further comprising:

a nail stack positioned on said main body opposite said handle;

a plurality of fasteners positioned in said nail stack;

means for ejection of one of said fasteners, with repetitive ejection after said safety trigger is actuated;

a piston reciprocally mounted within said piston cylinder, said piston is driven downward within said piston cylinder when pressurized gas is released from said main valve pressure housing into said piston cylinder;

a driver blade assembly reciprocally mounted within said piston cylinder, below said piston, and along said central axis of said piston cylinder, said driver blade assembly drives one of said plurality of fasteners out of said nail stack for securing two or more items together; and an inlet port for pressurized gas to feed into said main body housing.

13. The pneumatic nailer of claim 12, further comprising a pressurized gas source attachable to said inlet port, said gas source provides a pressurized gas to said main pressure chamber and said main valve housing.

14. The pneumatic nailer of claim 12, wherein said ejection means comprises:

a ram cap forming an upper end of said main valve housing, said ram cap is strikable by a hammer;

a lower end opening of said main valve housing, said lower end opening located opposite said ram cap;

a cylinder firing valve within said lower end opening, said cylinder firing valve attached to the lower end of said valve body, said cylinder firing valve moves upward when said ram cap is struck after said safety valve is actuated;

a spring between the lower end of said main valve and said cylinder firing valve, said spring located within said valve body around the lower end of said main valve, said spring compresses when said ram cap is struck;

an exterior firing valve seal, said exterior firing valve seal located between said cylinder firing valve and said main pressure chamber;

a cylinder exhaust valve, said exhaust valve positioned within said lower end opening, said exhaust valve fixed in position within said cylinder firing valve, and fixed to the lower end of said valve body; and a main valve return spring located between said main valve, said valve body, and said cylinder firing valve;

whereby said ram cap displaces said main valve downward, said firing valve seal is displaced in conjunction with movement of said cylinder firing valve, with resulting displacement of said cylinder firing valve, with transfer of pressurized gas into said piston cylinder positioned below said main valve and main valve housing, with movement of said driver blade assembly downward, and with ejection of one of said plurality of fasteners.

15. The pneumatic nailer of claim 14, wherein said main valve and cylinder firing valve are returned to a closed position by said main valve return spring, with associated closure of said lower end opening of said main valve housing, with said exterior firing valve seal returned to a sealed position with the internal walls of said main pressure chamber, to seal said main valve housing to receive pressurized gas from said main pressure chamber by said metering hole.

16. A method of operating a pneumatic fastening tool incorporating safe operation, comprising the steps of:

(a) providing a main body having an internal main pressure chamber in pneumatic communication with a main valve assembly;

(b) pressurizing said main valve assembly through a metering hole, said metering hole communicating between said main pressure chamber and a main valve chamber within said main valve assembly;

(c) manipulating a safety trigger connected to a safety valve in a handle passageway above said main body;

(d) hammering a ram cap above said main valve assembly;

(e) pressurizing a piston cylinder below said main valve chamber, said piston cylinder separated from said main pressure chamber by a cylinder firing valve;

(f) driving a piston downward within said piston cylinder, said piston moving a driver blade assembly downward;

(g) ejecting a fastener by said driver blade assembly from said cylinder;

(h) re-pressurizing said main valve chamber;

(i) re-manipulating said safety trigger and said safety valve, releasing pressure in said handle passageway; and (j) repeating said hammering step and subsequent steps;

wherein said step of manipulating said safety trigger must occur at least once before said hammering step for ejecting of said fastener.

17. The method of operating a pneumatic fastening tool of claim 16, wherein said step of manipulating further comprises the steps of:

(a) releasing pressure in said handle passageway;

(b) lowering pressure in said main valve chamber;

(c) lifting said cylinder firing valve positioned between said main valve chamber and said pressurized piston cylinder, said lifting step occurring due to the differing pressures within said main valve chamber and within said pressurized piston cylinder; and (d) re-positioning said cylinder firing valve after said driving and ejecting steps;

whereby said re-pressurizing step follows said repositioning step for re-pressurizing said piston cylinder and said valve chamber before said re-manipulating step resets said fastening tool for ejecting another fastener.

18. The method of operating a pneumatic fastening tool of claim 17, wherein said step of hammering further comprises the steps of:

(a) displacing a valve within said valve chamber; and (b) moving said cylinder firing valve, said moving step allowing said pressurizing step of said piston cylinder;

whereby said hammering step must follow said manipulating step or said moving step will not move said cylinder firing valve to allow operation of said pressurizing step and said following steps.

* * * * *